US007246422B2

(12) United States Patent
Iai et al.

(10) Patent No.: US 7,246,422 B2
(45) Date of Patent: Jul. 24, 2007

(54) FEEDING UNIT FOR ENGAGING ELEMENT METALLIC LINEAR MATERIAL IN CONTINUOUS MANUFACTURING APPARATUS FOR FASTENER STRINGER

(75) Inventors: Kenichiro Iai, Toyama-ken (JP); Koitsu Morioka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/364,028

(22) Filed: Feb. 28, 2006

(65) Prior Publication Data

US 2006/0196609 A1 Sep. 7, 2006

(30) Foreign Application Priority Data

Mar. 2, 2005 (JP) ..... 2005-057979

(51) Int. Cl.
*B21D 53/50* (2006.01)
*B23B 37/00* (2006.01)
*A44B 19/42* (2006.01)

(52) U.S. Cl. ..... 29/33.2; 29/34 A; 29/410; 29/769; 83/78; 83/679; 156/361; 156/543

(58) Field of Classification Search ..... 29/33.2, 29/34 A, 766, 767, 769, 56.5, 33 R, 408, 29/566.1; 156/361, 543; 83/23, 44, 78, 83/167, 210, 363, 365, 367, 371, 379
See application file for complete search history.

(56) References Cited

U.S. PATENT DOCUMENTS 2,125,707 A * 8/1938 Anderson et al. ..... 29/713
2,141,200 A * 12/1938 Sundback ..... 29/33.2
2,619,148 A * 11/1952 Camp ..... 29/33.2
2,744,560 A * 5/1956 Johns et al. ..... 29/33.2
2,763,051 A * 9/1956 Firing ..... 29/33.2
3,425,306 A * 2/1969 Wetzler ..... 83/210
4,070,937 A * 1/1978 Off et al. ..... 83/27
4,242,785 A * 1/1981 Shimai ..... 29/408
4,265,014 A * 5/1981 Yoshieda et al. ..... 29/766
4,432,126 A * 2/1984 Sugahara ..... 29/410
4,550,477 A * 11/1985 Iai ..... 29/33.2

(Continued)

FOREIGN PATENT DOCUMENTS

JP 57008043 A * 1/1982
JP 63087458 A * 4/1988

*Primary Examiner*—Dana Ross
(74) *Attorney, Agent, or Firm*—Everest Intellectual Property Law Group; Michael S. Leonard

(57) ABSTRACT

The invention provides a feeding unit for a metallic linear material having an irregular shaped section applicable to a continuous manufacturing apparatus for a fastener stringer, the feeding unit comprising the seventh and eighth rollers rotatably supported at their fixed positions, the ninth and tenth rollers opposing the seventh and eighth rollers and rotatably supported at both ends of a movable roller support member, wherein the roller support member is rotatably supported around its center and urged elastically in a direction perpendicular to a straight line connecting the centers of roller shafts of the seventh and eighth rollers, thereby the feeding roller protecting the metallic linear material from easily slipping out of feeding rollers, returning the linear material to its original track immediately even if the linear material slips out for a while, and feeding the metallic linear material stably and securely without damaging the linear material or ratchet wheel.

6 Claims, 8 Drawing Sheets

U.S. PATENT DOCUMENTS 4,594,925 A * 6/1986 Ishikawa ..... 83/209
4,796,497 A * 1/1989 Morita ..... 83/23
5,357,663 A * 10/1994 Morioka et al. ..... 29/34 A
5,361,471 A * 11/1994 Morioka et al. ..... 29/33.2
5,367,758 A * 11/1994 Morioka et al. ..... 29/410
5,406,872 A * 4/1995 Conley et al. ..... 83/109

* cited by examiner

FEEDING UNIT FOR ENGAGING ELEMENT METALLIC LINEAR MATERIAL IN CONTINUOUS MANUFACTURING APPARATUS FOR FASTENER STRINGER

BACKGROUND OF THE INVENTION

1. Field of the Invention

The present invention relates to a feeding unit for metallic linear material applicable to a continuous manufacturing apparatus for fastener stringer which intermittently feeds an engaging element metallic linear material for a slide fastener to an engaging element implanting section, the metallic linear material having a substantially Y-shaped section molded preliminarily by rolling.

2. Description of the Related Art

As for this kind of slide fastener engaging element, a long metallic linear material having a circular section is formed into a substantially Y shape in its lateral section through a plurality of mill rolls, and is intermittently fed by an amount corresponding to a single engaging element and successively cut out into a predetermined thickness by a cutting punch and a cutting die to obtain an engaging element material. By molding its engaging head into a mountain like shape by a forming punch and a forming die, an engaging element (hereinafter referred to as a linear engaging element) is molded. Usually, the cutting punch is fixed to a part of the machine frame, and the cutting die and forming die are integrated with a ram, and at the time of retraction, cut out a linear material with the cutting punch. Then, the forming punch is actuated to mold the linear material into a mountain like shape at its retraction stop end. Thereafter, the ram advances toward an engaging element attaching portion of a fastener tape, and a pressurizing punch is actuated at its advancement stop end position, so that right and left leg portions of the engaging element are pressurized and attached to the engaging element attaching portion of the fastener tape. After the engaging element is attached to the fastener tape, an intermittent feeding portion is actuated so as to intermittently feed the fastener tape by an equal pitch. Such a molding method for a linear engaging element has been disclosed in, for example, Japanese Patent Publication No. 59-51813.

FIG. 5 of patent document 1 shows a schematic configuration of a linear material feeding unit for intermittently feeding the metallic linear material by an amount corresponding to a single engaging element. A conventional linear material feeding unit intermittently rotates a ratchet wheel by a ratchet pawl provided at a front end of a cam driven mechanism which is reciprocated by a rotation of a cam provided on a main shaft. A rotation of the ratchet wheel is transmitted to a drive roller of the linear material feeding unit which shares a supporting shaft with the ratchet wheel, so that the metallic linear material is nipped by a pair of rollers comprising the drive roller and a driven roller and is intermittently fed synchronously with attachment of the engaging element. At this time, if an interval between the drive roller and the driven roller is set up, the interval is unchanged.

The above-mentioned metallic linear material has a substantially Y-shaped section comprising a head portion for forming a head of an engaging element and leg portions for forming right and left leg portions of the engaging element. Thus, a continuous convex row is provided along the peripheral face of the drive roller, and a concave groove is provided along the peripheral face of the driven roller. On the other hand, because the metallic linear material has an irregular shaped section, the metallic linear material may be fed in a twisted state although slightly by the time when it reaches the drive roller. When the metallic linear material is fed from between the drive roller and the driven roller, the metallic linear material is nipped between the convex row of the drive roller and the concave groove of the driven roller such that the convex row of the drive roller is fitted to between the right and left leg portions of the metallic linear material while the concave groove in the driven roller is fitted to the head portion of the metallic linear material.

A contact pressure applied to the metallic linear material between the rollers needs to be increased in order to feed the metallic linear material having such an irregular shaped section securely without any slippage by nipping with the pair of the drive roller and driven roller. On the other hand, both the sectional areas of the head portion and the right and left leg portions of the metallic linear material having the irregular shaped section are small, and the linear material is often fed in a twisted state, though it is slight, by the time when it reaches the drive roller and the driven roller. Even if the linear material is introduced into between the rollers in such a twisted state, the metallic linear material is caught between the rotating rollers in the twisted state, so that the metallic linear material is damaged seriously.

Further, the metallic linear material having the irregular shaped section is likely to slip out of fitting between the drive roller and the driven roller with acceleration of manufacturing speed. If the metallic linear material slips out of the fitting condition, it cannot return to its original fitting condition easily, so that the sectional shape of the metallic linear material is deformed. Also, as described above, if the metallic linear material is caught between a drive roller and a contact roller, an excessive load is applied to the drive roller, thereby finally stopping the rotation. At this time, not only the metallic linear material is damaged, but also the ratchet wheel or ratchet pawl which rotates the drive roller is damaged.

It can be considered to elastically urge the driven roller to the drive roller in order to eliminate such an inconvenience. However, according to such a conventional method of feeding the metallic linear material with the drive roller and drive roller in one pair, the contact pressure of each roller with respect to the metallic linear material needs to be set high in order to exclude the aforementioned slippage. When the metallic linear material is caught between both the rollers, the driven roller cannot move against a strong elastic force, thereby still damaging the metallic linear material and the ratchet wheel and the like. If only the pair of the drive roller and driven roller is provided, when a metallic linear material slips out of the rollers, a track of the slipped linear material changes. Thus, the linear material cannot return to its original nipping condition, thereby causing the same inconvenience as described above.

The present invention has been achieved to solve such a problem, and an object of the invention is to provide a feeding unit for metallic linear material applicable for a continuous manufacturing apparatus for a fastener stringer, the feeding unit protects the metallic linear material from slipping out of feeding rollers easily, and even if the linear material slips out for a while, returns it to its original track immediately, thereby feeding the metallic linear material securely despite its irregular shaped section without damaging the linear material or ratchet wheel.

SUMMARY OF THE INVENTION

To achieve the above-described object, the basic feature of this application is a feeding unit for an engaging element metallic linear material having an irregular shaped section applicable to a continuous manufacturing apparatus for a fastener stringer, being characterized in that the feeding unit comprises seventh and eighth rollers rotatably supported at their fixed positions on a upstream side of the engaging element metallic linear material and ninth and tenth rollers which oppose respective seventh and eighth rollers and are rotatably supported by both ends of a movable roller support member, and the roller support member is rotatably supported around a center thereof, and is urged elastically in a direction perpendicular to a straight line connecting centers of roller shafts of the seventh and eighth rollers by urging means.

The feeding unit of the metallic linear material of the present invention is actuated so as to intermittently feed the engaging element upward only by an amount corresponding to a single engaging element. When feeding of the linear material is completed, the linear material is projected from the cutting die by a length corresponding to the thickness of a single engaging element. Next, the cutting die begins to retract, a projected portion of the linear material is cut with the cutting punch and the engaging element is moved from the cutting die to the forming die at a rear end stop position of the cutting die. At this time, a pressurizing hammer is stopped to regulate a horizontal movement of the engaging element, so that the forming die supports the attaching leg portions of the engaging element from both sides.

Thereafter, as the forming punch lowers, a pressure pad also lowers so as to form the engaging head into a mountain-like form. At this time, the feeding unit is stopped. Next, the cutting die and the forming die advance in cooperation, and then, a pair of right and left pressurizing punches begins to operate, so that the attaching leg portions of the engaging element are pressed by a pressurizing face formed on the pressurizing punch and consequently deformed in a direction of approaching each other. After the engaging element is attached to an engaging element attaching portion of a fastener tape supplied intermittently and kept in standby condition, the intermittent feeding unit is actuated, so that an engaging element attaching portion for a next position of the fastener tape is fed to a pressurizing portion of the pressurizing punch while guided by the tape guide.

In recent years, a manufacturing process has been accelerated remarkably not only in a manufacturing apparatus for this kind of fastener stringer but also in a manufacturing process in every manufacturing field. Although an operating portion which operates simultaneously with a main operating portion can follow up an operation timing of the main operating portion at a conventional manufacturing speed, it has become incapable of following up accelerated speed, thereby often leading to reduction of productivity. This is the same for the feeding unit for the metallic linear material, and particularly, the intermittent feeding timing of the metallic linear material does not come to meet a rotation speed of a main shaft rotating at a high speed. Also, even if it is intended to achieve secure feeding with only a pair of the drive roller and driven roller, the metallic linear material becomes easy to slip out of those rollers because of such a high speed. Thus, not only the metallic linear material but also the ratchet wheel and ratchet pawl which are a drive source of the drive roller are damaged, thereby leading to stop of manufacturing of the fastener stringer.

According to the present invention, a metallic linear material is nipped at four points, that is, by a pair of seventh and eighth rollers and the other pair of ninth and tenth rollers when it is fed out. Therefore, even if the metallic linear material is about to slip out of the nipping by the seventh and ninth roller, there is a high probability that the metallic linear material may be nipped by the eighth and tenth rollers. In addition, even if the metallic linear material is about to slip out of the nipping by the seventh and ninth rollers, the metallic linear material is nipped by the seventh and ninth rollers again. Further, according to the present invention, the ninth and tenth rollers supported by the ends of a single roller support member elastically press the central portion of the roller support member against the seventh and eighth rollers.

As a consequence, the pressing force of the ninth and tenth rollers against the seventh and eighth rollers is always equalized, and further, an elastic urging force weaker than that made by conventional a pair of rollers is obtained. Thus, even if the metallic linear material is fed in a slightly twisted state, of roller pairs to which the twisted portion is fed, the ninth and tenth rollers retract resisting the urging force and continue to feed the metallic linear material. Consequently, the twisted state is automatically corrected, thereby not damaging the metallic linear material. As a result, the metallic linear material is protected from being caught strongly by the seventh to tenth rollers, thereby protecting the ratchet wheel and ratchet pawl which are a drive source from a damage.

Preferably, the feeding unit comprises release and contact means for releasing and contacting the ninth and tenth rollers from and to the seventh and eighth rollers together with the roller support member. Consequently, exchange of the metallic linear material and inspection of the feeding roller are facilitated.

Preferably, the seventh and eighth rollers comprise a convex row continuous along a peripheral face thereof respectively, and the ninth and tenth rollers comprise a concave groove continuous along a peripheral face thereof respectively.

Preferably, the roller support member is composed of a V-shaped lever member.

Further, the roller support member is constitute of a V-shaped lever member, the pair of the ninth and tenth roller is supported at both ends thereof while the central bent portion is supported such that the both ends are capable of rotating. In this case, when the central bent portion is urged toward the seventh and eighth rollers by the urging means perpendicularly to a straight line connecting the centers of the shafts of the seventh and eighth rollers, the pressing force of the ninth and tenth rollers against the seventh and eighth rollers is equalized easily, thereby achieving secure feeding of the metallic linear material.

Preferably, the feeding unit comprises a drive mechanism for driving all of the seventh to tenth rollers synchronously.

Preferably, the seventh and eighth rollers comprise a same structure and the ninth and tenth rollers comprise a same structure, the drive mechanism comprises gears, by which opposing seventh and ninth rollers and opposing eighth and tenth rollers are engaged with each other, and respective gears of the seventh and eighth rollers engage a single drive gear.

In this case, if the pitch between teeth of each gear of the seventh to tenth rollers is set equal, the metallic linear material feeding speeds of all the rollers coincide with one another, thereby achieving smooth feeding of the metallic linear material. The effects which the present invention exerts are considerably great.

DESCRIPTION OF THE PREFERRED EMBODIMENTS

Hereinafter, a preferred embodiment of the present invention will be described specifically with reference to the accompanying drawings.

Figure 1:
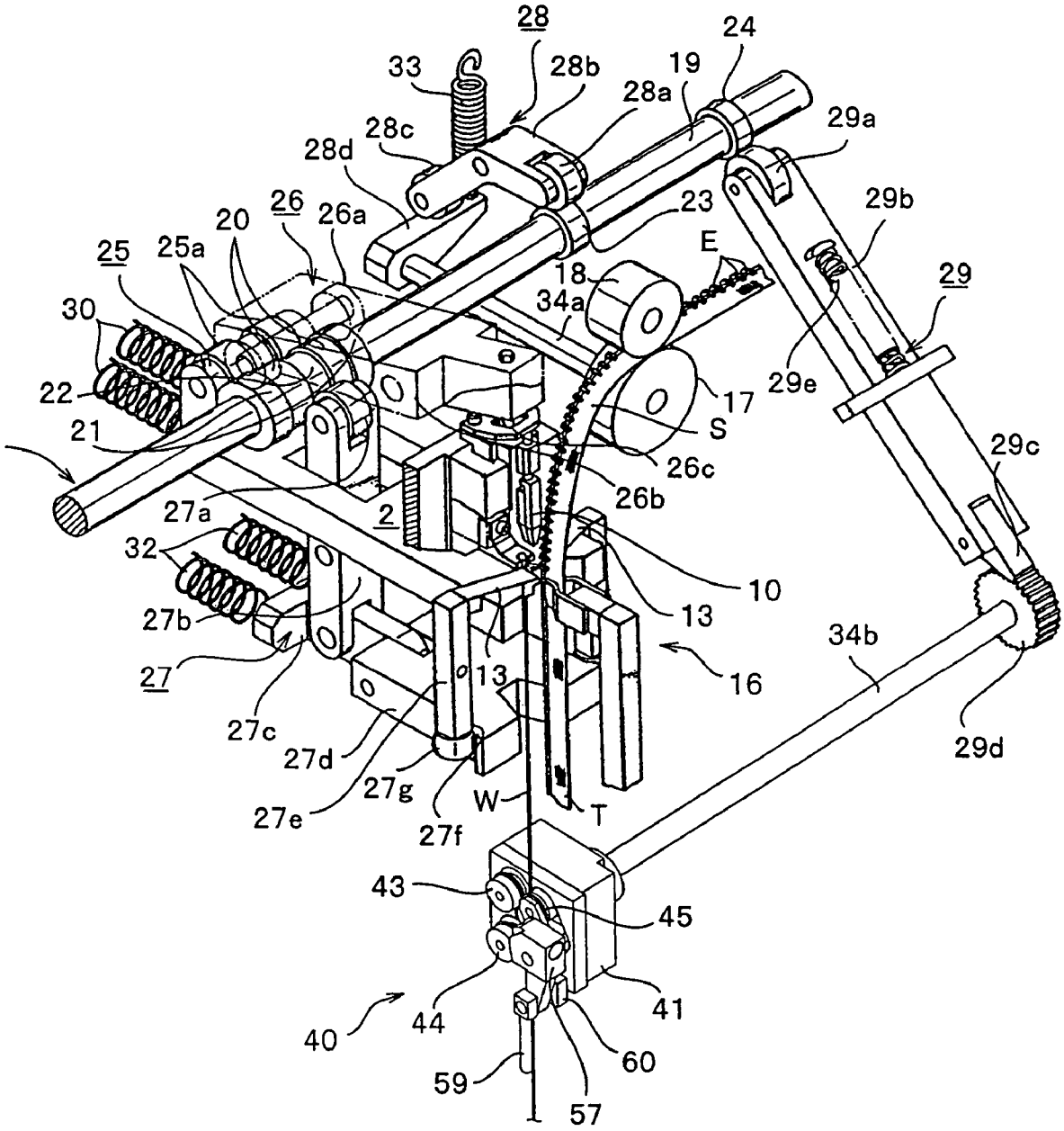
FIG. 1 is a perspective view showing major portions of a continuous manufacturing apparatus for a fastener stringer, to which the present invention is applied.
Figure 2:
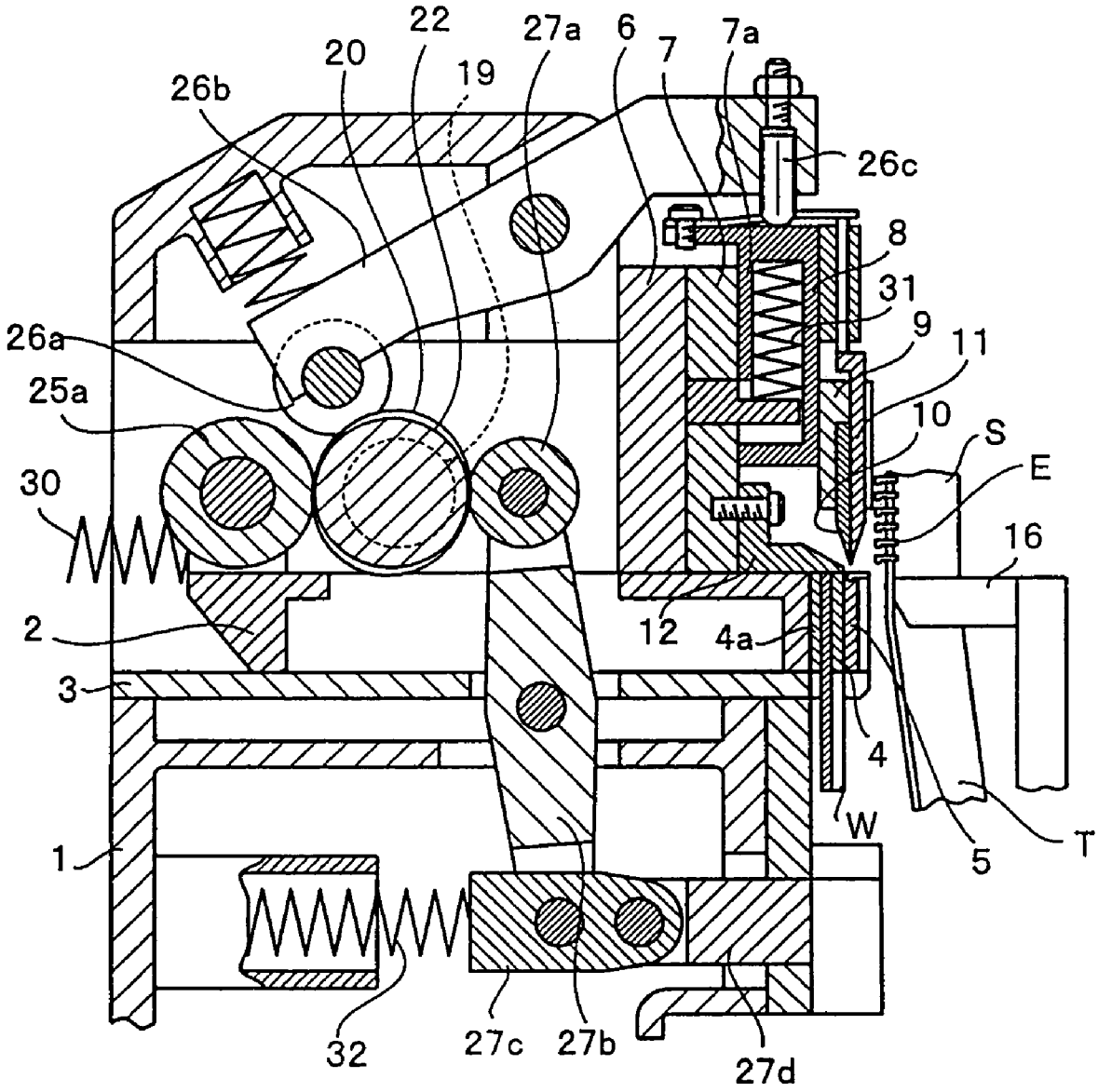
FIG. 2 is a longitudinal sectional view of an engaging element forming portion of the same apparatus.

FIGS. 1 and 2 schematically show an example of a fastener stringer manufacturing apparatus of the present invention. The indicated structure is substantially not different from the apparatus disclosed in the Japanese Patent Publication No. 59-51813. Thus, the following outline of the apparatus is based on descriptions of the publication. In these figures, a first ram 2 is supported on a base 1 through a ram guide 3 so as to freely reciprocate horizontally, and a cutting die 4 and a forming die 5 for forming an engaging head of an engaging element E into a mountain-like shape are provided on the front portion of the first ram 2 in this order in the advancement direction of the first ram 2. The cutting die 4 has an introduction passage 4*a* for introducing an irregular shape linear material W for an engaging element, the irregular shape linear material W having, for example, a Y-shaped lateral section.

A set plate 6 supported by the base 1 is disposed above the front end of the first ram 2, and a ram guide 7 is mounted on the set plate 6. A second ram 8 is provided on the ram guide 7 so as to be capable of moving up and down vertically with respect to the horizontal reciprocation of the first ram 2. A forming punch 10 for forming the engaging head of the engaging element E into a mountain like shape and a pressure pad 11 for pressing both leg portions of the engaging element E at the time of forming into the mountain-like shape are mounted on the front face of the second ram 8 through a punch holder 9. A cutting punch 12 capable of making sliding contact with the top face of the front portion of the first ram 2 is fixed on the bottom end of the ram guide 7. A pair of pressurizing punches 13 is provided on both sides of the forming die 5, so that the attaching leg portions of the engaging element E after its engaging head is formed are pressurized from both sides, right and left so as to attach the engaging element E to a tape T.

As shown in FIGS. 1 and 2, the engaging element linear material W having a Y-shaped section is intermittently supplied by an amount corresponding to the thickness of a single engaging element E by feed rollers to the linear material insertion hole 4*a* in the cutting die 4. The fastener tape T is supplied from below and guided to a tape guide 16, in which the tape T is turned to a slide fastener stringer S with the engaging elements E attached. The slide fastener stringer S is intermittently pulled by an intermittent drive roller 17 and a pressure roller 18 of an intermittent feeding portion.

A main shaft 19 is provided above the rear portion of the first ram 2, and a first ram drive cam 20, a forming punch actuating cam 21, a pressurizing punch actuating cam 22, a stringer feeding cam 23 and a linear material feeding cam 24 are provided on the main shaft 19. The respective cams 20 to 24 are respectively connected to the first ram 2, the forming punch 10, the pressurizing punch 13, the intermittent drive roller 17 and the linear material feed roller via cam driven mechanisms 25 to 28, and these components are actuated.

The cam driven mechanism 25 of the first ram 2 has a first roller 25*a* which makes a rolling contact with the first ram actuating cam 20, and the roller 25*a* is journaled by the rear portion of the first ram 2. The first ram 2 is urged in a forward direction by a compression spring 30, and is horizontally reciprocated by a rotation of the first ram drive cam 20. Further, the cam face of the first ram drive cam 20 is formed so as to stop the first ram 2 in a predetermined time at its front end position and rear end position.

On the other hand, the cam driven mechanism 26 of the forming punch 10 comprises a second roller 26*a*, a lever 26*b*, a pin 26*c*, and a compression spring 26*d*. The second roller 26*a* makes a rolling contact with the forming punch actuating cam 21. The roller 26*a* is journaled by one end of the lever 26*b*, and a central portion of the lever 26*b* is mounted on the apparatus main body via a shaft. The pin 26*c* is attached to the other end of the lever 26*b*, and makes contact with the head of the second ram 8. The compression spring 26*d* returns the lever 26*b*. The second ram 8 incorporates a compression spring 31 for urging the ram upward, and the lever 26*b* swings by the cam 21 so that the second ram 8 lowers and the second ram 8 returns to its original position by the compression spring 31.

The cam driven mechanism 27 of the pressurizing punch 13 comprises a third roller 27*a*, a lever 27*b*, a link 27*c*, a third ram 27*d*, and actuating levers 27*e*. The third roller 27*a* makes a rolling contact with the cam 22. The lever 27*b* journals the roller 27*a* at a top end thereof, extends downward, and is supported on the base 1 via a shaft at a central portion thereof. A central portion of the link 27*c* is supported at the bottom end of the lever 27*b* via a shaft. The third ram 27*d* has the front end of the link 27*c* connected to a rear portion thereof. The pressurizing punch 13 makes contact with the top of the actuating levers 27*e*, and a central portion of the actuating levers 27*e* is connected via a shaft. As shown in FIG. 1, the side face at the front end of the third ram 27*d* is formed as a cam face 27*f* extending outward, and a cam receiver 27*g* is provided at the bottom end of the actuating lever 27*e*. When the third ram 27*d* is retracted by the cam face 27*f* and the cam receiver 27*g*, the actuating lever 27*e* swings so as to actuate the pressurizing punch 13. Restoration of the third ram 27*d* to its original position is carried out by a compression spring 32.

As shown in FIG. 1, the cam driven mechanism 28 for feeding a stringer comprises: a fourth roller 28*a* which makes a rolling contact with the stringer feeding cam 23; a first lever 28*b* in which the fourth roller 28*a* is journaled by one end thereof and a fifth roller 28*c* is journaled by the other end thereof and whose central portion is supported via a shaft; and a second lever 28*d* which swings downward by a sixth roller 29*a* and is urged upward by a pulling spring 33. A transmission shaft 34*a* of the intermittent drive roller 17, in which a single-direction clutch (not shown) is mounted on an intermediate portion thereof, is connected to the proximal end of the second lever 28*d*, so that the intermittent drive roller 17 is intermittently rotated only in a single direction so as to feed the fastener stringer S.

Figure 7:
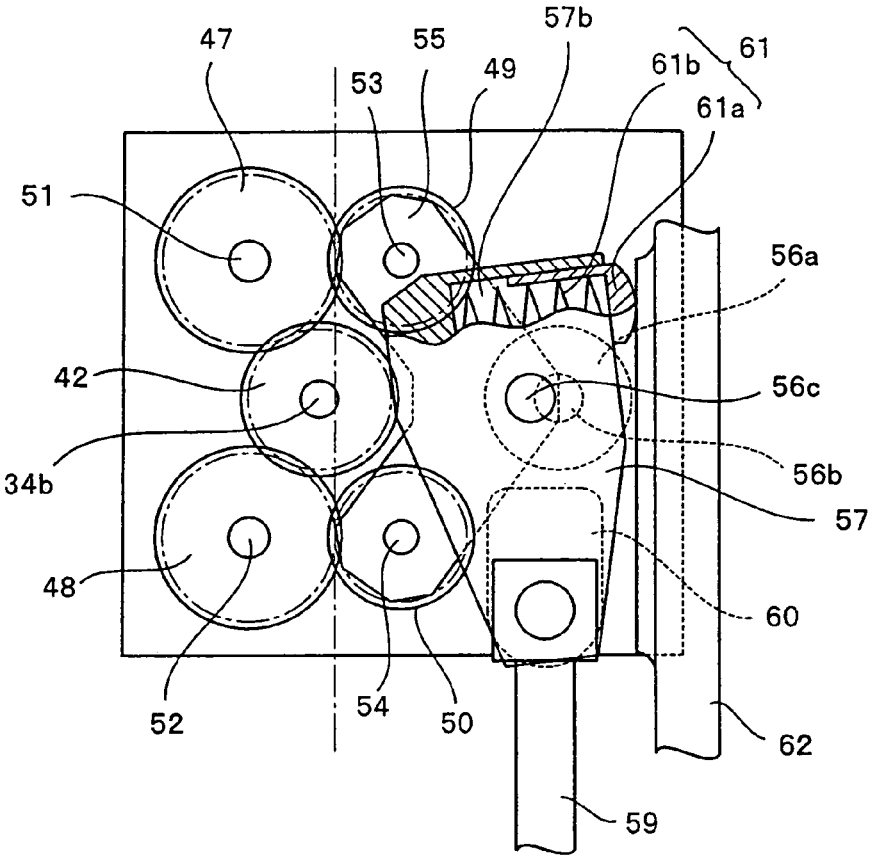
FIG. 7 is a partially broken front view showing an engaging state of each gear and drive gear of the seventh to tenth rollers and an interlocking relation thereof with release and contact means.

The cam driven mechanism 29 for feeding a linear material comprises: a sixth roller 29*a* which makes a rolling contact with the cam 24; a slider 29*b* having the roller 29*a* supported via a shaft at one end thereof; a ratchet 29*c* attached to the other end of the slider 29*b*; and a ratchet wheel 29*d* which is intermittently rotated only in a single direction every predetermined angle by the ratchet 29*c*. A drive gear 42 for feeding a linear material shown in FIG. 7 is attached to the other end of a supporting shaft 34*b* of the ratchet wheel 29*d*. The irregular shape metallic linear material W is intermittently supplied through the seventh to tenth rollers 43 to 46 which form the main configuration of the present invention by an intermittent rotation of the drive gear 42. Restoration of the slider 29*b* to its original position is carried out by a compression spring 29*e*.

When the advancement of the first ram 2 stops, feeding of the irregular shape metallic linear material W is completed, so that the irregular shape metallic linear material W is projected over the cutting die 4 by a predetermined thickness. In the former half of this process, the attachment of the engaging element E to the fastener tape T is completed, and the fastener stringer S is pulled up immediately after the pressuring punches 13, 13 leave the leg portions of the engaging element. When the engaging head of the engaging element E leaves the forming die 5, the first ram 2 begins to retract. Thus, the attached engaging element is never caught by the forming die 5 which is retracted by the first ram 2.

The linear material W is cut by the retraction of the first ram 2. At the time of this retraction, pulling up of the fastener stringer is completed. When the first ram 2 is located at its retraction position so that the engaging head is formed, the pressurizing punches 13 are actuated so as to nip the engaging element E from both sides through the leg portions. After the attachment of the engaging element by the pressurizing punches 13 is started halfway of the advancement of the first ram 2, the first ram 2 advances to the forward end position, and hereinafter, the above-mentioned steps are repeated.

Figure 3:
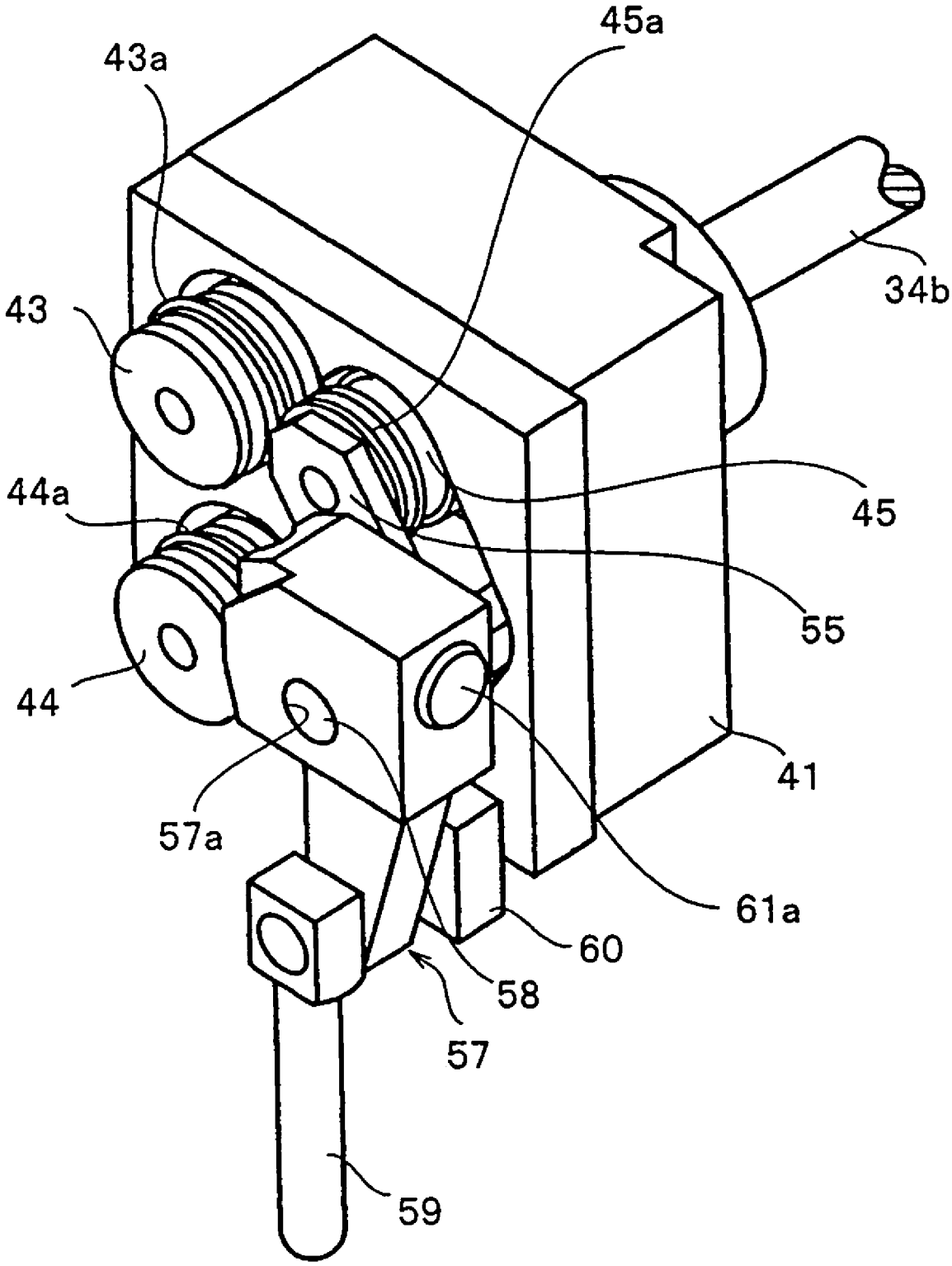
FIG. 3 is an enlarged perspective view showing a feeding unit for an irregular shape metallic linear material for an engaging element, according to a preferred embodiment of the present invention.
Figure 4:
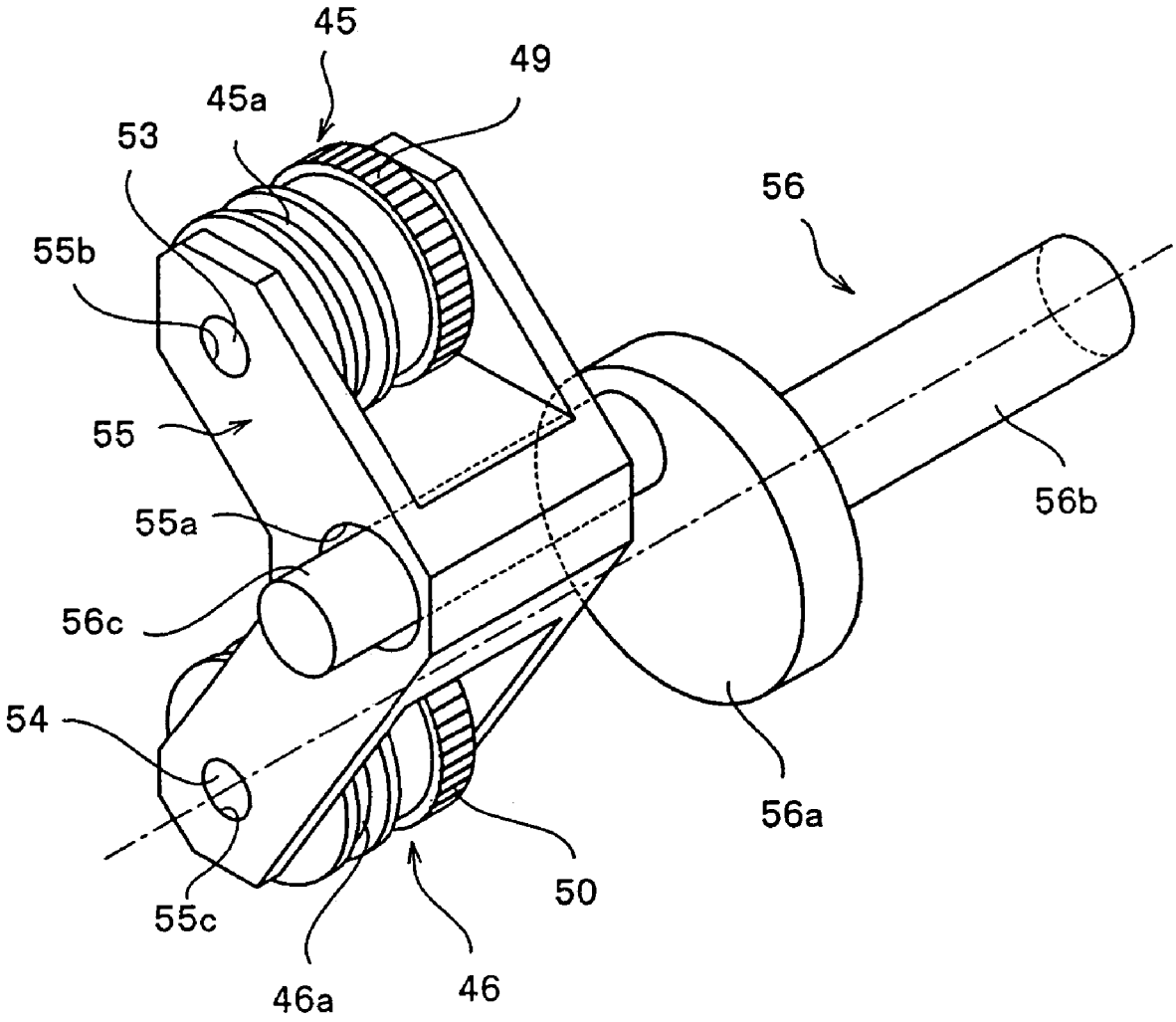
FIG. 4 is a perspective view showing an example of a supporting shaft portion for ninth and tenth rollers of the same apparatus.
Figure 5:
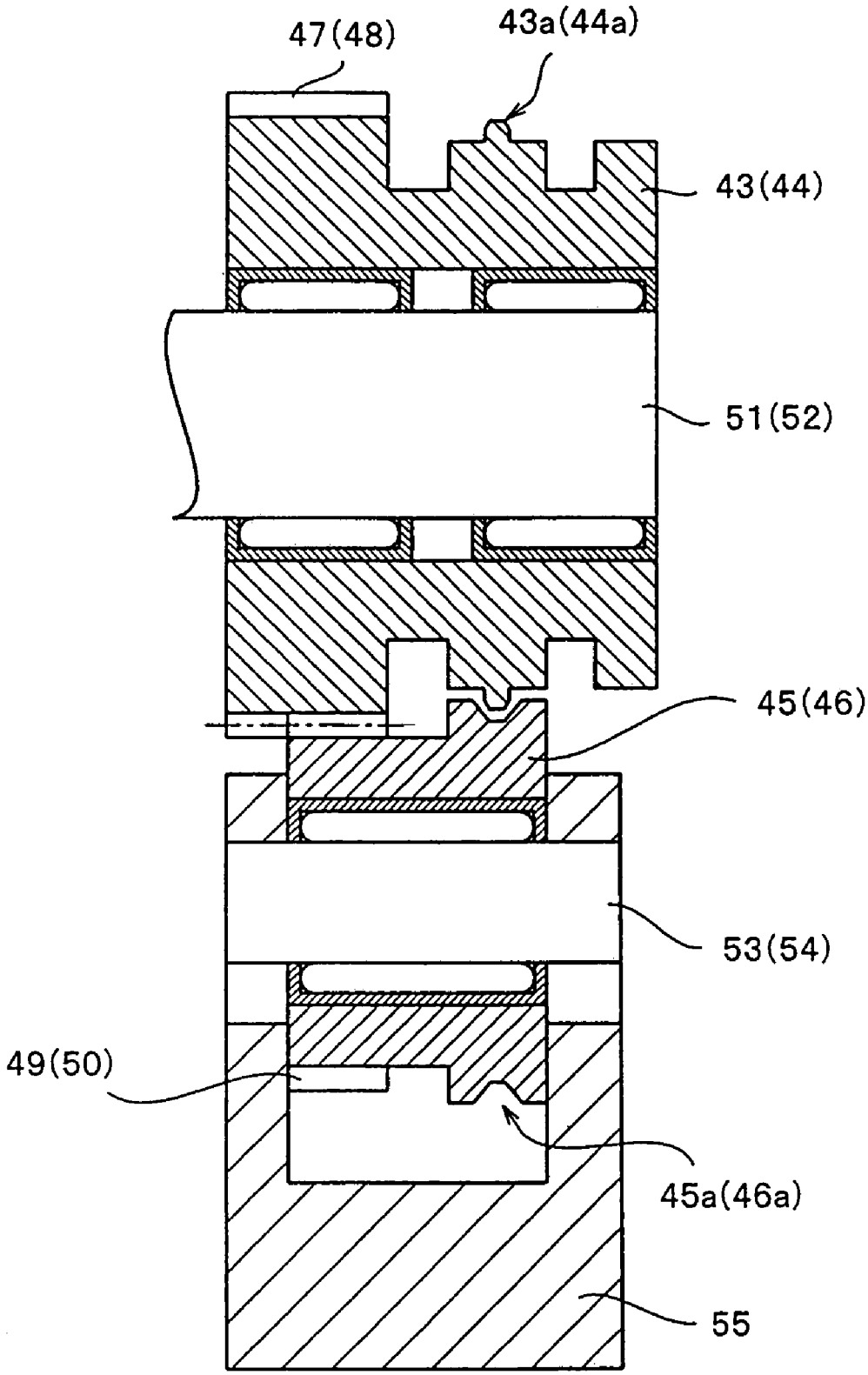
FIG. 5 is a sectional view showing the structure and arrangement of seventh and eighth rollers and the ninth and tenth rollers.
Figure 6:
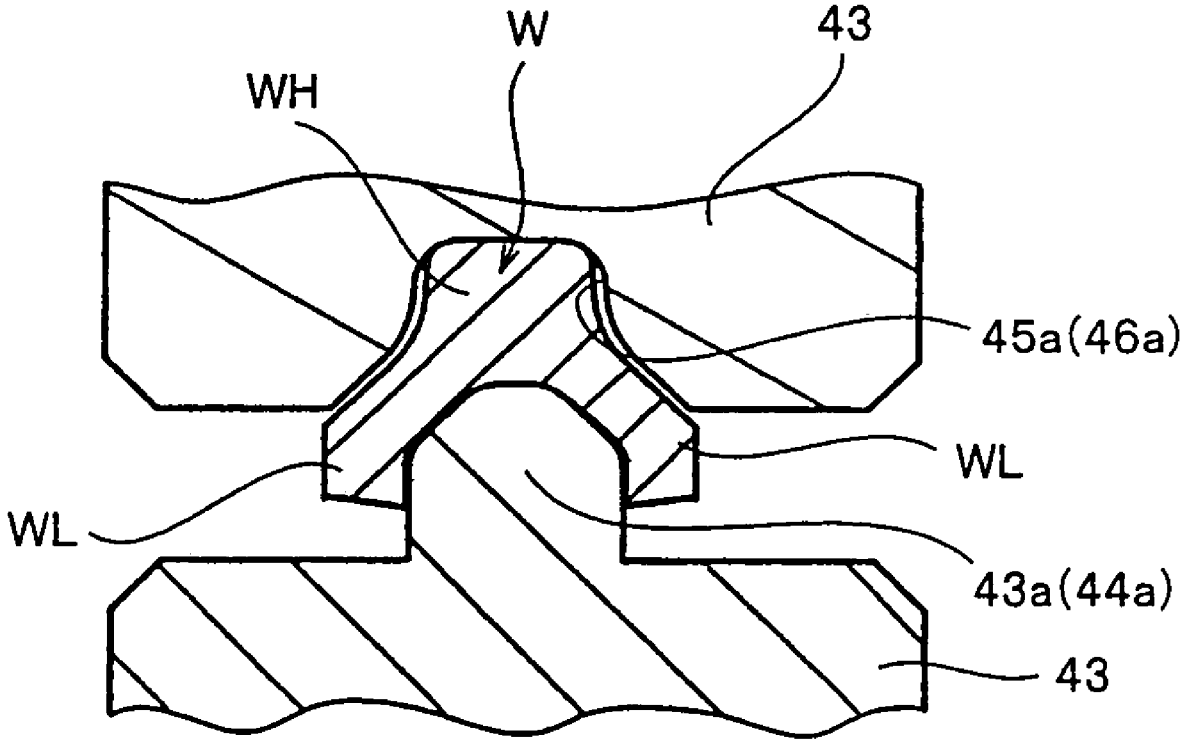
FIG. 6 is a major portion sectional view showing a state in which a metallic linear material is nipped with the seventh and eighth rollers and the ninth and tenth rollers in enlargement.
Figure 8:
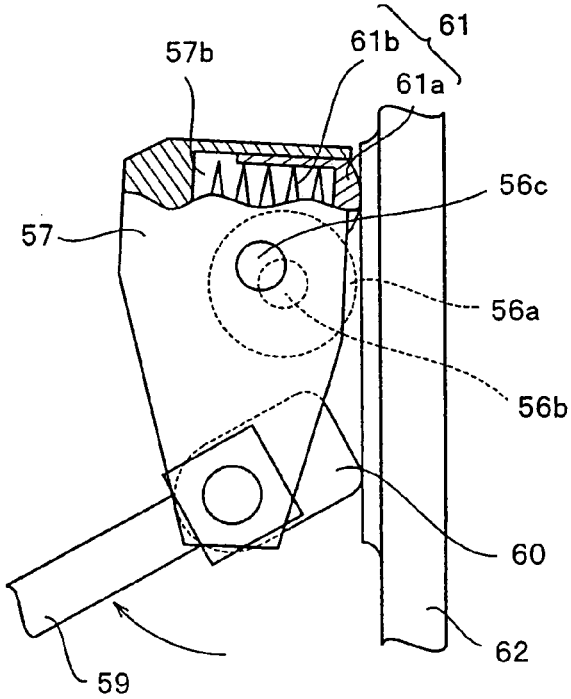
FIG. 8 is an explanatory view for explaining a state in which the release and contact means is separated.

FIG. 3 is a perspective view showing the appearance of the intermittent feeding unit for a metallic linear material, according to a preferred embodiment of the present invention. FIG. 4 is a sectional view showing the structure of the ninth and tenth rollers and a supporting state of the gears. FIG. 5 is a major portion sectional view showing a fitting state of the seventh to tenth rollers in enlargement. FIG. 6 is a major portion sectional view showing a state in which the linear material W is held in enlargement. FIGS. 7 and 8 are explanatory diagrams showing an example of arrangement of gears in the box and an example of the mechanism of the release and contact means of the ninth and tenth rollers.

The metallic linear material feeding unit 40 of this embodiment is constructed in a unit, and the seventh to tenth rollers 43 to 46 are exposed outside. However, the first to fourth gears 47 to 50 integrally attached to these rollers 43 to 46 and the drive gear 42 for applying a drive power to the seventh to tenth rollers rollers 43 to 46 are incorporated in the box 41. The seventh and eighth rollers 43, 44 of this embodiment have the same shape and structure, and the ninth and tenth rollers 45, 46 have the same shape and structure.

Thus, nothing but the seventh roller 43 and the ninth roller 45 will be described in detail below. As shown in FIG. 5 or 6, the section of the irregular shape metallic linear material W indicates a substantially Y-like shape comprising an engaging head portion WH and right and left attaching leg portions WL. For the reason, as shown in FIGS. 2, 5 and 6, on the peripheral face of the seventh roller 43, a protrusion 43*a* to which the engaging element head portion WH and the crotch portion of the right and left leg portions WL are fitted is formed so as to be continuous along the peripheral face of the seventh roller 43. On the other hand, on the peripheral face of the ninth roller 45, a concave groove 45*a* which is fitted to between the right and left leg portions WL is formed so as to be continuous along the peripheral face of the ninth roller 45. A protrusion 44*a* is formed on the eighth roller 44 same as the seventh roller 43, and a concave groove 46*a* is formed in the tenth roller 46. The respective protrusions 43*a*, 44*a* of the seventh and eighth rollers 43, 44 have a shape which is loosely fitted to only the bottom portion of the crotch portion of the right and left leg portions WL of the metallic linear material W. The concave grooves 45*a*, 46*a* formed in the ninth and tenth rollers 45, 46 have a shape which is fitted to the engaging head portion WH closely, thereby preventing the right and left leg portions WL from being deformed.

The first to fourth gears 47 to 50 having a center on the center line of the seventh to tenth rollers 43 to 46 are integrally formed on the seventh to tenth rollers 43 to 46 of this embodiment. FIG. 7 shows an engagement state between those gears 47 to 50 and the drive gear 42 attached to one end of the supporting shaft 34*b* of the ratchet wheel 29*d*. According to the same figure, the single drive gear 42 engages the gears 47, 48 of the seventh and eighth rollers 43, 44. When the ninth and tenth rollers 45, 46 are located at a position for feeding the metallic linear material W, the third and fourth gears 49, 50 engage the gears 47, 48 of the seventh and eighth rollers 43, 44.

As shown in the same figure, the seventh and eighth rollers 43, 44 have the same structure, and the diameter of those rollers is substantially the same as the diameter of the first and second gears 47, 48 and the number of tooth is the same. On the other hand, although the ninth and tenth rollers 45, 46 have the same structure, the diameter of those rollers is set smaller than the diameter of the seventh and eighth rollers 43, 44, and substantially the same as the diameter of the third and fourth gears 49, 50. Although the number of tooth of the third and fourth gears 49, 50 is smaller than the number of tooth of the first and second gears 47, 48, all the pitches between teeth are equal. Thus, although the rotation speed of the seventh and eighth rollers 43, 44 is slower than that of the ninth and tenth rollers 45, 46, the feeding amount of the irregular shape metallic linear material W is equal.

As shown in FIG. 5, the seventh and eighth rollers 43, 44 having the above-described configuration are rotatably supported through bearing (not shown) by first and second fixed supporting shafts 51, 52 whose end portions are fixed to part of the above-described box. On the other hand, as shown in FIGS. 3 and 4, the ninth and tenth rollers 45, 46 are rotatably supported through bearing (not shown) by third and fourth fixed supporting shafts 53, 54 fixed to both ends of a flat V-shaped roller support member 55. As shown in FIG. 4, the roller support member 55 has such a structure in which two V-shaped plates are disposed in parallel to each other with a predetermined gap at its central bent portion, and a shaft loosely inserting hole 55*a* is formed at the central bent portion. Respective pairs of the shaft supporting holes 55*b*, 55*b*; 55*c*, 55*c* for fixing and supporting both ends of the fixed supporting shafts 53, 54 are formed in both end portions thereof. The ninth and tenth rollers 45, 46 are rotatably supported by the fixed supporting shafts 53, 54 in a space between the respective shaft supporting holes 55*b*, 55*b*; 55*c*, 55*c*.

According to this embodiment, as shown in FIG. 4, the roller support member 53 is rotatably supported on an eccentric shaft member 56. The eccentric shaft member 56 has a shaft body 56*b* whose one end is fixed to the center of a surface of a disc portion 56*a*, and further has an eccentric shaft body 56*c* whose one end is fixed to the eccentric position of the other surface of the disc portion 56*a*. The eccentric shaft member 56 is so constructed that the other end of the shaft body 56*b* is rotatably supported by a part of the box 41, and that the eccentric shaft body 56*c* is inserted loosely into the shaft loosely inserting hole 55*a* formed in the central bent portion of the roller support member 53. Then, the release and contact means of the present invention, which is a release and contact member 60, is fixed to a shaft end projecting outwardly from the shaft loosely inserting hole 55*a* of the eccentric shaft body 56*c*.

As shown in FIGS. 3 and 7, the release and contact means of this embodiment comprises a main body 57, a handle portion 59, a release and contact member 60, a release and contact spring member sliding hole 57*b*, and a release and contact spring member 61. The main body 57 is fixed to the shaft end of the eccentric shaft body 56*c*. The handle portion 59 is fixed to a front face side end portion of a pin 58 inserted into a pin hole 57*a* formed at a bottom end of the main body 57. The release and contact member 60 is composed of a rectangular plate piece fixed to a rear face side end of the pin 58. The release and contact spring member sliding hole 57*b* is formed above the pin hole 57*a* in the main body 57 perpendicularly to the pin hole 57*a*, and the bottom face of the release and contact spring member sliding hole 57*b* is directed to a straight line connecting the shaft centers of the seventh and eighth rollers 43, 44. In addition, the release and contact spring member sliding hole 57*b* is open in a direction of leaving the bottom face thereof. The release and contact spring member 61 is inserted slidably in the release and contact spring member sliding hole 57*b*. The release and contact spring member 61 comprises: a cup-like member 61*a* which is fitted slidingly into the release and contact spring member sliding hole 57*b*; and a compression spring 61*b* which is inserted into a hollow portion formed by the bottom face of the release and contact spring member sliding hole 57*b* and the cup-like member 61*a*, the compression spring 61*b* urging the cup-like member 61*a* outwardly within the release and contact spring member sliding hole 57*b*.

The intermittent feeding unit 40 for the irregular shape metallic linear material according to this embodiment has the above-described configuration. Thus, when the irregular shape metallic linear material W is intermittently fed at the time of manufacturing with the stringer manufacturing apparatus, the cup-like member 61*a* fitted slidingly into the release and contact spring member sliding hole 57*b* is kept into contact with a frame 62 disposed at an adjacent position such that the compression spring 61*b* is contracted. A reaction force of the spring 61*b* is applied to the central bent portion of the roller support member 55 through the release and contact means main body 57 fixed on the eccentric shaft body 56*c* inserted into the shaft loosely inserting hole 55*a* in the central bent portion of the roller support member 55. Consequently, the ninth and tenth rollers 45, 46 are pressed equally against the seventh and eighth rollers 43, 44 through the irregular shape metallic linear material W.

In the intermittent feeding unit for the irregular shape metallic linear material W of this embodiment, the irregular shape metallic linear material W is fed in a state in which the linear material is pressed elastically by equal urging force while supported at four points by two pairs of contact rollers driven positively, in which all the rollers disposed in the feeding direction are in synchronism. Thus, even if the irregular shape metallic linear material W is introduced into a feeding roller column with a slight twisting, the ninth and tenth rollers 45, 46 move in a direction of leaving the seventh and eighth rollers 43, 44 instantaneously resisting the urging force. Consequently, all the supports at the four points are never lost at the same time but any pair of the two pairs always nips the irregular shape metallic linear material W while correcting it in a normal state so as to feed the irregular shape metallic linear material W. As a result, the irregular shape metallic linear material W returns to its original normal nipped condition by a pair of rollers quickly, so that the irregular shape metallic linear material W is never caught by the pair of rollers, and no excessive load is applied to the ratchet wheel which is a drive source. Accordingly, not only the linear material but also the ratchet wheel 29*d* and the ratchet pawl 29*c* are protected from a damage, thereby achieving a smooth and accurate intermittent feeding.

When the handle portion 59 which is the release and contact means is rotated clockwise in the state shown in FIG. 7, the disc portion 56*a* and the shaft body 56*b* are rotated around their shafts, so that as shown in FIG. 8, the eccentric shaft body 56*c* is rotated clockwise around the shaft. As a result, the release and contact means main body 57 supported by the eccentric shaft body 56*c* is also rotated clockwise around the shafts of the disc portion 56*a* and the shaft body 56*b*. Then, the cup-like member 61*a* is pushed against the frame 62, and the cup-like member 61*a* slides into the release and contact spring member sliding hole 57*b* while compressing the compression spring 61*b*. Consequently, the bottom portion of the release and contact means main body 57 leaves the frame 62 so as to separate the ninth and tenth rollers 45, 46 supported by the roller support member 53 from the seventh and eighth rollers 43, 44. This separation facilitates insertion of the irregular shape metallic linear material W into gaps between the seventh and eighth rollers 43, 44 and the ninth and tenth rollers 45, 46, and also facilitates inspection of the feeding unit.

Figure 9:
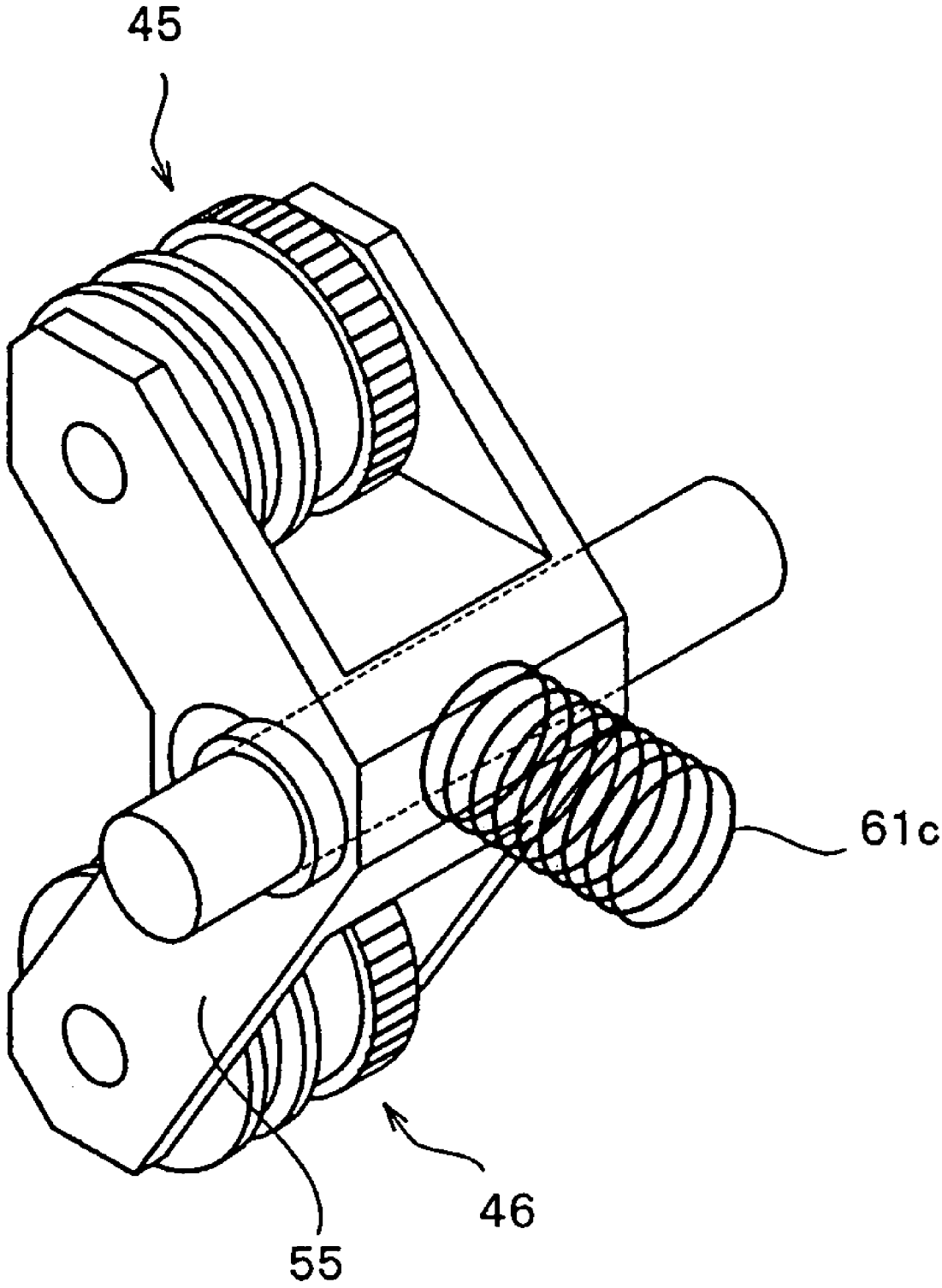
FIG. 9 is a major portion perspective view showing a modification of the supporting structure of the ninth and tenth rollers of the feeding unit of the present invention.

In the meantime, it is permissible to omit the release and contact means so as to urge the rear face of the central bent portion of the roller support member 55 with the compression spring 61*c* or the like as shown in FIG. 9. In this case, no eccentric shaft member is required for the roller support member 53, and the shaft may be an ordinary linear member. In this modification as well, the roller support member 53 is constructed to be rotatable with respect to the linear shaft member.

What is claimed is:

1. A feeding unit for an engaging element metallic linear material (W) having an irregular shaped section applicable to a continuous manufacturing apparatus for a fastener stringer (S), wherein the feeding unit comprises:

seventh and eighth rollers rotatably supported at their fixed positions on a upstream side of the engaging element metallic linear material (W); ninth and tenth rollers which oppose respective seventh and eighth rollers and are rotatably supported by both ends of a movable roller support member; and the roller support member is rotatably supported around a center thereof, and is urged elastically in a direction perpendicular to a straight line connecting centers of roller shafts of the seventh and eighth rollers by urging means.

2. The feeding unit for the engaging element metallic linear material (W) according to claim 1, further comprising release and contact means for releasing and contacting the ninth and tenth rollers from and to the seventh and eighth rollers together with the roller support member.

3. The feeding unit for the engaging element metallic linear material (W) according to claim 1 or 2, wherein the seventh and eighth rollers comprise a convex row continuous along a peripheral face thereof respectively, and the ninth and tenth rollers comprise a concave groove continuous along a peripheral face thereof respectively.

4. The feeding unit for the engaging element metallic linear material (W) according to claim 1 or 2, wherein the roller support member is composed of a V-shaped lever member.

5. The feeding unit for the engaging element metallic linear material (W) according to claim 1 or 2, further comprising a drive mechanism for driving all of the seventh to tenth rollers synchronously.

6. The feeding unit for the engaging element metallic linear material (W) according to claim 5, wherein the seventh and eighth rollers comprise a same structure and the ninth and tenth rollers comprise a same structure, the drive mechanism comprises gears, by which opposing seventh and ninth rollers and opposing eighth and tenth rollers are engaged with each other, and respective gears of the seventh and eighth rollers engage a same drive gear.

* * * * *